US011015537B2

(12) United States Patent
Sturman

(10) Patent No.: US 11,015,537 B2
(45) Date of Patent: May 25, 2021

(54) MULTIPLE ENGINE BLOCK AND MULTIPLE ENGINE INTERNAL COMBUSTION POWER PLANTS FOR BOTH STATIONARY AND MOBILE APPLICATIONS

(71) Applicant: Sturman Digital Systems, LLC, Woodland Park, CO (US)

(72) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 0 days.

(21) Appl. No.: 16/577,464

(22) Filed: Sep. 20, 2019

(65) Prior Publication Data

US 2020/0011251 A1 Jan. 9, 2020

Related U.S. Application Data

(63) Continuation of application No. PCT/US2018/024374, filed on Mar. 26, 2018.

(Continued)

(51) Int. Cl.
*F02D 9/02* (2006.01)
*F02B 73/00* (2006.01)

(Continued)

(52) U.S. Cl.
CPC ..... *F02D 9/02* (2013.01); *F02B 73/00* (2013.01); *F02D 25/00* (2013.01); *F02D 41/3845* (2013.01); *F02D 2009/0201* (2013.01)

(58) Field of Classification Search
CPC ..... F02D 9/02; F02D 25/00; F02D 41/3845; F02D 2009/0201; F02B 73/00

(Continued)

(56) References Cited

U.S. PATENT DOCUMENTS 3,811,271 A * 5/1974 Sprain ..... F02G 3/02 60/39.6
4,565,167 A * 1/1986 Bryant ..... F02B 33/22 123/560

(Continued)

FOREIGN PATENT DOCUMENTS

CN 105020009 11/2015
WO WO-2016/196839 12/2016

OTHER PUBLICATIONS

"International Search Report and Written Opinion of the International Searching Authority dated Jun. 22, 2018; International Application No. PCT/US2018/024374", Jun. 22, 2018.

*Primary Examiner* — Mahmoud Gimie
(74) *Attorney, Agent, or Firm* — Womble Bond Dickinson (US) LLP

(57) ABSTRACT

Power plants using multiple identical engine block assemblies to form multiple engines, each contributing to a common output or outputs, and each using an intake manifold, an exhaust manifold and an air rail. Air is first compressed by some engine cylinders and delivered to the air rail, and then coupled to combustion cylinders from the air rail. Compressions and combustion may be in the same cylinders, the same engine block assembly but different cylinders or in different engine block assemblies. Multiple engines in the power plants are less costly than single large engines because of the quantity of manufacture and ease of maintenance. Various embodiments are disclosed.

31 Claims, 15 Drawing Sheets

Related U.S. Application Data

(60) Provisional application No. 62/476,378, filed on Mar. 24, 2017.

(51) Int. Cl.
*F02D 25/00* (2006.01)
*F02D 41/38* (2006.01)

(58) Field of Classification Search
USPC ..... 123/585, 26, 70 R
See application file for complete search history.

(56) References Cited

U.S. PATENT DOCUMENTS 4,787,207 A 11/1988 Kristensen et al.
5,265,564 A * 11/1993 Dullaway ..... F02B 33/22 123/560
5,460,329 A 10/1995 Sturman
5,526,778 A 6/1996 Springer
5,638,781 A 6/1997 Sturman
5,713,316 A 2/1998 Sturman
5,720,261 A 2/1998 Sturman et al.
5,829,396 A 11/1998 Sturman
5,954,030 A 9/1999 Sturman et al.
5,960,753 A 10/1999 Sturman
5,970,956 A 10/1999 Sturman
6,012,644 A 1/2000 Sturman et al.
6,085,991 A 7/2000 Sturman
6,148,778 A 11/2000 Sturman
6,161,770 A 12/2000 Sturman
6,173,685 B1 1/2001 Sturman
6,257,499 B1 7/2001 Sturman
6,270,322 B1 8/2001 Hoyt
6,308,690 B1 10/2001 Sturman
6,360,728 B1 3/2002 Sturman
6,415,749 B1 7/2002 Sturman et al.
6,557,506 B2 5/2003 Sturman
6,575,126 B2 6/2003 Sturman
6,739,293 B2 5/2004 Turner et al.
7,025,326 B2 4/2006 Lammert et al.
7,032,574 B2 4/2006 Sturman
7,108,200 B2 9/2006 Sturman
7,182,068 B1 2/2007 Sturman et al.
7,341,028 B2 3/2008 Klose et al.
7,387,095 B2 6/2008 Babbitt et al.
7,412,969 B2 8/2008 Pena et al.
7,565,867 B2 7/2009 Donnelly et al.
7,568,632 B2 8/2009 Sturman
7,568,633 B2 8/2009 Sturman
7,694,891 B2 4/2010 Sturman
7,717,359 B2 5/2010 Sturman
7,730,858 B2 6/2010 Babbitt et al.
7,954,472 B1 * 6/2011 Sturman ..... F02D 41/0087 123/299
8,196,844 B2 6/2012 Kiss et al.
8,282,020 B2 10/2012 Kiss et al.
8,342,153 B2 1/2013 Sturman
8,366,018 B1 2/2013 Giordano et al.
8,412,441 B1 * 4/2013 Sturman ..... F02D 33/02 701/105
8,579,207 B2 11/2013 Sturman
8,628,031 B2 1/2014 Kiss
8,629,745 B2 1/2014 Sturman et al.
8,733,671 B2 5/2014 Sturman
9,181,890 B2 11/2015 Sturman
2002/0017573 A1 2/2002 Sturman
2006/0192028 A1 8/2006 Kiss
2007/0007362 A1 1/2007 Sturman
2007/0113906 A1 5/2007 Sturman et al.
2007/0157894 A1 * 7/2007 Scuderi ..... F02D 17/026 123/70 R
2007/0245982 A1 * 10/2007 Sturman ..... F02B 21/00 123/26
2008/0264393 A1 * 10/2008 Sturman ..... F02B 9/04 123/568.14
2009/0038597 A1 * 2/2009 Phillips ..... F01L 1/465 123/70 R
2010/0012745 A1 1/2010 Sturman
2010/0229838 A1 * 9/2010 Sturman ..... F02D 19/0689 123/525
2010/0263645 A1 * 10/2010 Scuderi ..... F02B 33/44 123/70 R
2012/0073551 A1 * 3/2012 Branyon ..... F02B 67/10 123/70 R
2013/0261911 A1 * 10/2013 Zanotti ..... F16H 61/2807 701/58
2014/0147238 A1 * 5/2014 Izumi ..... E02F 9/123 414/687
2014/0360473 A1 12/2014 Sturman
2015/0354171 A1 * 12/2015 Sakamoto ..... B60W 20/11 180/65.26
2017/0022882 A1 1/2017 Sturman

* cited by examiner

MULTIPLE ENGINE BLOCK AND MULTIPLE ENGINE INTERNAL COMBUSTION POWER PLANTS FOR BOTH STATIONARY AND MOBILE APPLICATIONS

CROSS REFERENCE TO RELATED APPLICATIONS

This application is a continuation of International Application No. PCT/US2018/024374 filed on Mar. 26, 2018, which claims the benefit of U.S. Provisional Application No. 62/476,378 filed on Mar. 24, 2017, the disclosures of which are incorporated herein by reference.

BACKGROUND OF THE INVENTION

1. Field of the Invention

The present invention relates to the field of internal combustion engines for stationary and mobile applications.

2. Prior Art

Historically, internal combustion engines have been designed and built in various sizes as needed for the respective applications, and typically with fixed engine valve operation as determined by an engine driven camshaft. This results in engines of various sizes being manufactured in various numbers, with some engines, particularly special purpose and large engines, being manufactured in small quantities. This makes such engines very expensive, and expensive for the user to maintain an adequate spare parts inventory for the maintenance of such engines. Further, maintenance normally requires stopping the engine, which in some applications, is particularly troublesome. Sometimes a fully operative backup engine is provided for both the scheduled and unscheduled down times of the main engine.

Also it is rare for an internal combustion engine to be always operated at or near its maximum efficiency operating point. Instead, engine loads for both stationary and mobile applications tend to vary widely with time, and usually well away from the maximum efficiency of the engine.

DETAILED DESCRIPTION OF THE PREFERRED EMBODIMENTS

Figure 1A:
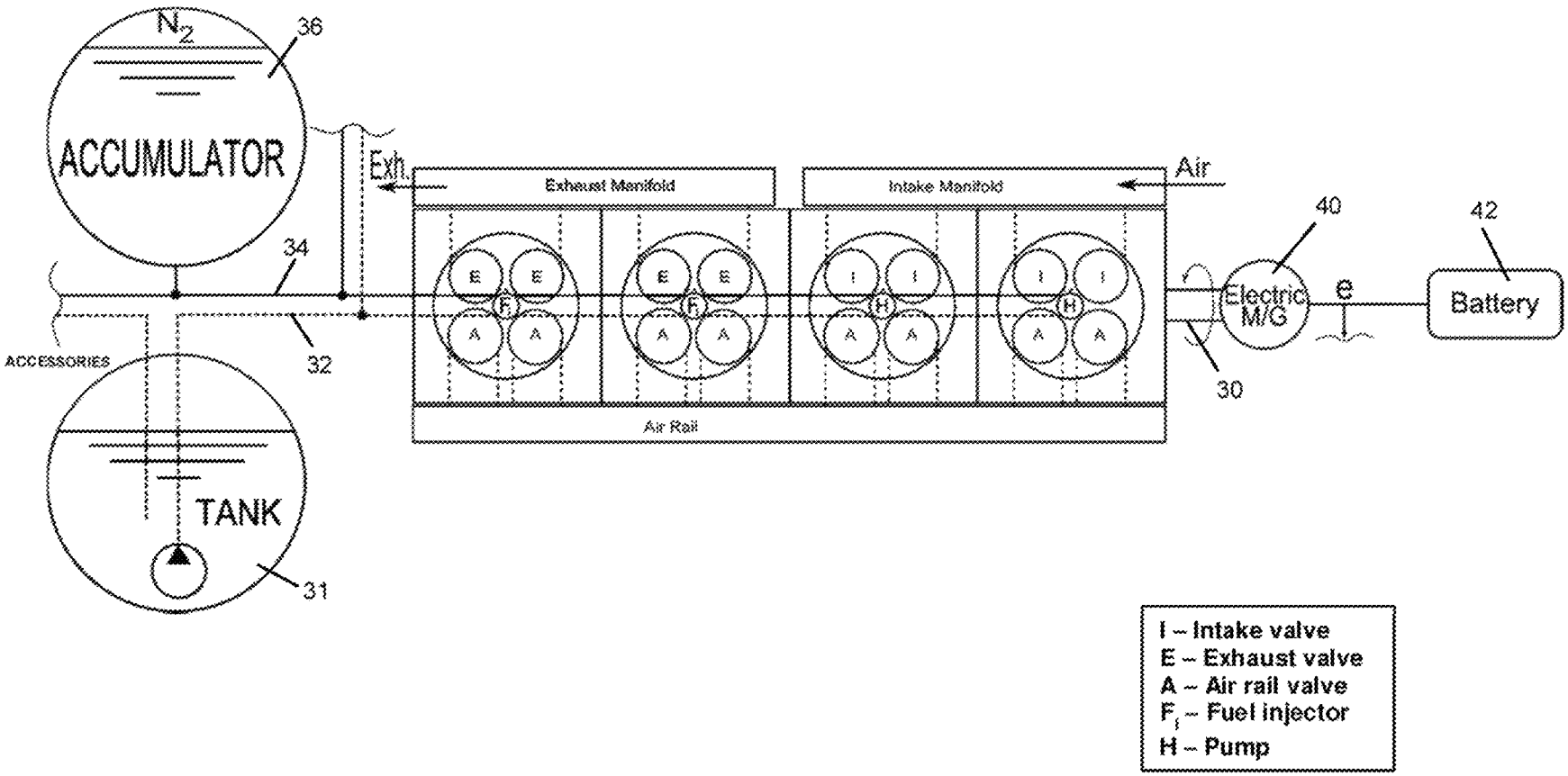
FIG. 1A illustrates a four-cylinder piston engine in accordance with an embodiment of the present invention

The present invention comprises multiple engine block and multiple engine internal combustion power plants for both stationary and mobile applications that are highly efficient over a wide range of loads and can be self-optimizing under substantially all operating conditions. In particular, in one embodiment the power plant is based on a four-cylinder piston engine schematically illustrated in FIG. 1A.

The engine illustrated includes a head with a valve layout generally as shown, each with four poppet valves per cylinder. The right side of the head has intake valves I for taking in air through the intake manifold, with two valves labeled A for each cylinder for delivering air under pressure to the air rail. The left side of the head illustrated in FIG. 1A similarly has four poppet valves per cylinder, two of which are labeled A for receiving air from the air rail and two are labeled E for delivering air (exhaust) to the exhaust manifold. The right side of the head also has a central element labeled H, an embodiment of which is illustrated in FIG. 2. In this embodiment, the hydraulic pump H includes a plunger 20 for reciprocating in a cylinder 22. The plunger 20 is loosely coupled to the engine piston 34 so that it may find its own center, in spite of any radial or rocking motion of the piston 24, though of course is positively driven in the vertical direction as a result of its coupling to the piston 24 in the respective cylinder.

At the top of the pump assembly is a solenoid operated spool valve 26 which couples the volume 28 over the plunger 20 to a tank 31 through line 32, providing a supply of the hydraulic fluid to the volume 28 over the plunger 20 on the downward motion of the piston 24, and then coupling the output of the hydraulic pump H through lines 34 to a hydraulic accumulator 36 as the plunger 30 rises with piston 24. Of course since the solenoid operated spool valve 26 is electronically controlled, the pumping action can be electronically terminated at any time by not delivering more hydraulic fluid to the accumulator during the upward motion of the plunger 20, but rather allowing that same fluid to continue to reciprocate with the plunger by leaving the fluid coupling to the tank 31 open. The pressure in the tank 31 may be maintained adequate to always encourage the plunger tightly against the respective piston to prevent any noise or other problems developing because of the loose mechanical coupling of the plunger to the piston 24.

The cylinders of the left side of the engine head illustrated in FIG. 1A have a fuel injector $F_1$ at the center of the engine valve pattern for injecting a suitable liquid fuel, to be discussed more thoroughly subsequently. In this embodiment, the engine is intended to be operated as a compression ignition engine with the output from crankshaft 30 being coupled to an electric motor/generator 40 for charging a battery 42 and providing electrical output E for other uses, though the power plants of the present invention may be used as desired, such as for providing a direct mechanical output, for driving a hydraulic pump for a hydraulic power output, by way of example, or some combination of various power outputs.

All of the engine valves I, A and E, as well as the fuel injectors $F_1$, are electronically actuated by techniques that are now well known. Examples of electronically controlled valve actuation systems include U.S. Pat. Nos. 5,638,781, 5,713,316, 5,960,753, 5,970,956, 6,148,778, 6,173,685, 6,308,690, 6,360,728, 6,415,749, 6,557,506, 6,575,126, 6,739,293, 7,025,326, 7,032,574, 7,182,068, 7,341,028, 7,387,095, 7,568,633 7,730,858, 8,342,153 and 8,629,745, and U.S. Patent Application Publication No. 2007/0113906, though fuel injectors having other electronic control may also be used. Examples of electronically controlled fuel injection systems include U.S. Pat. Nos. 5,460,329, 5,720,261, 5,829,396, 5,954,030, 6,012,644, 6,085,991, 6,161,770, 6,257,499, 7,032,574, 7,108,200, 7,182,068, 7,412,969, 7,568,632, 7,568,633, 7,694,891, 7,717,359, 8,196,844, 8,282,020, 8,342,153, 8,366,018, 8,579,207, 8,628,031, 8,733,671 and 9,181,890, U.S. Patent Application Publication Nos. 2002/0017573, 2006/0192028, 2007/0007362 and 2010/0012745, and International Publication No. WO2016/196839, though again other types of electronically controlled fuel injectors may be used, though as shall be subsequently seen, high speed valve actuation systems and high speed fuel injection systems are a definite benefit with the present invention.

Figure 2:
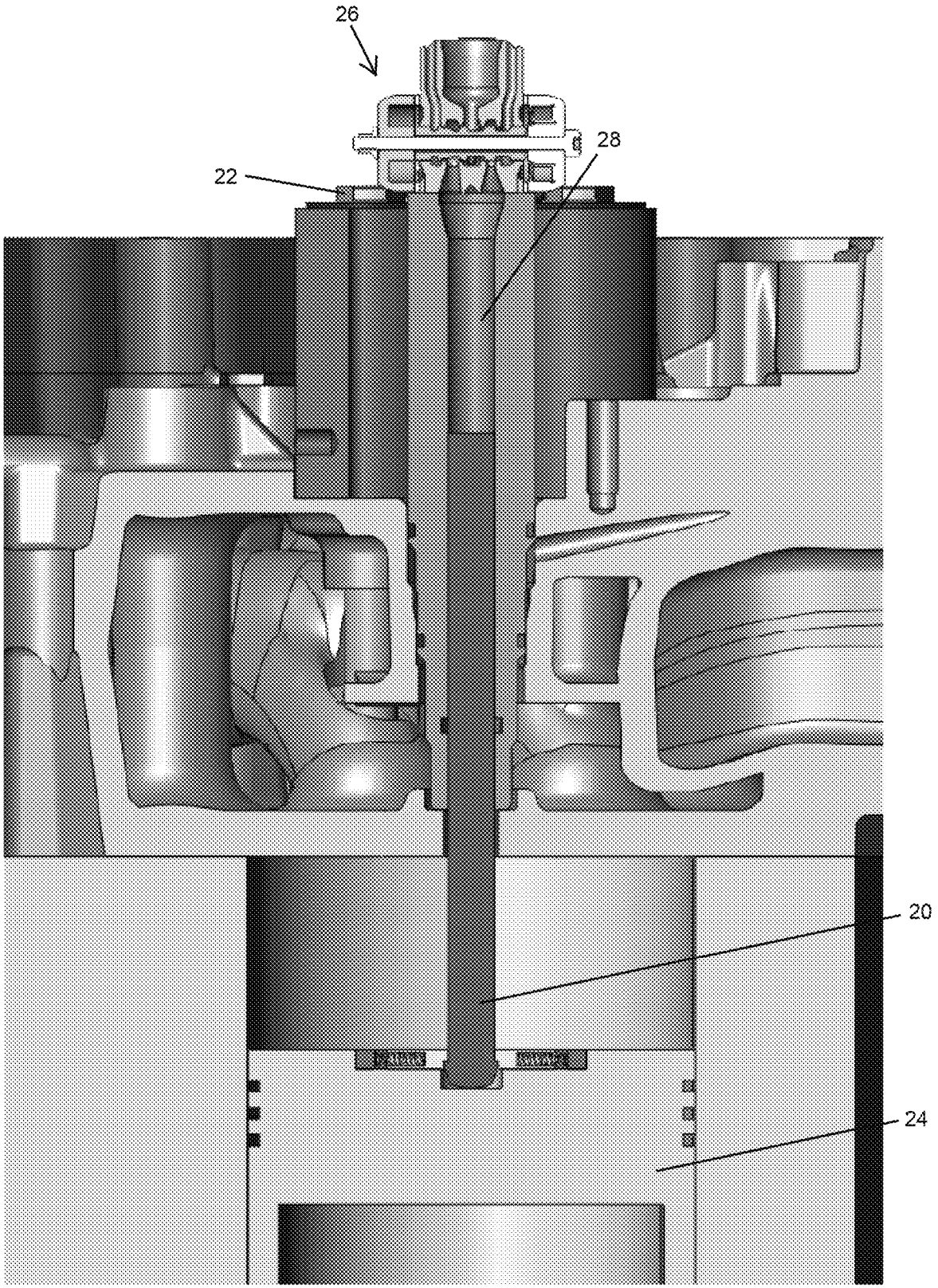
FIG. 2 illustrates various details of the hydraulic pumps H of FIGS. 1A, 1B and 1C.

The engine of FIG. 1A is operated with the right cylinders compressing intake air and the right cylinders receiving the compressed air and executing a compression ignition combustion cycle, much like a supercharged engine, though a very different type of compression ignition engine, in that since all valves, injectors and hydraulic pumps are electronically controllable, all operations may be electronically controlled, including compression ratio and even the operating cycles (or for that matter even the direction of rotation), as the valve and injector control allows operating the engine in a two stroke, four stroke, or six or eight stroke cycles by keeping the intake I and exhaust E valves either closed or open throughout the extra cycles and not operating the injectors during any inactive cycles. Similarly, one may on occasion choose to operate only one compression and one combustion cylinder, or even one combustion cylinder and alternate between using one and two compression cylinders for extra air flow through that combustion cylinder. The possible combinations and timing of operation, the operating cycles possible, etc., of this and other embodiments to be disclosed herein, are substantially endless.

Figure 1B:
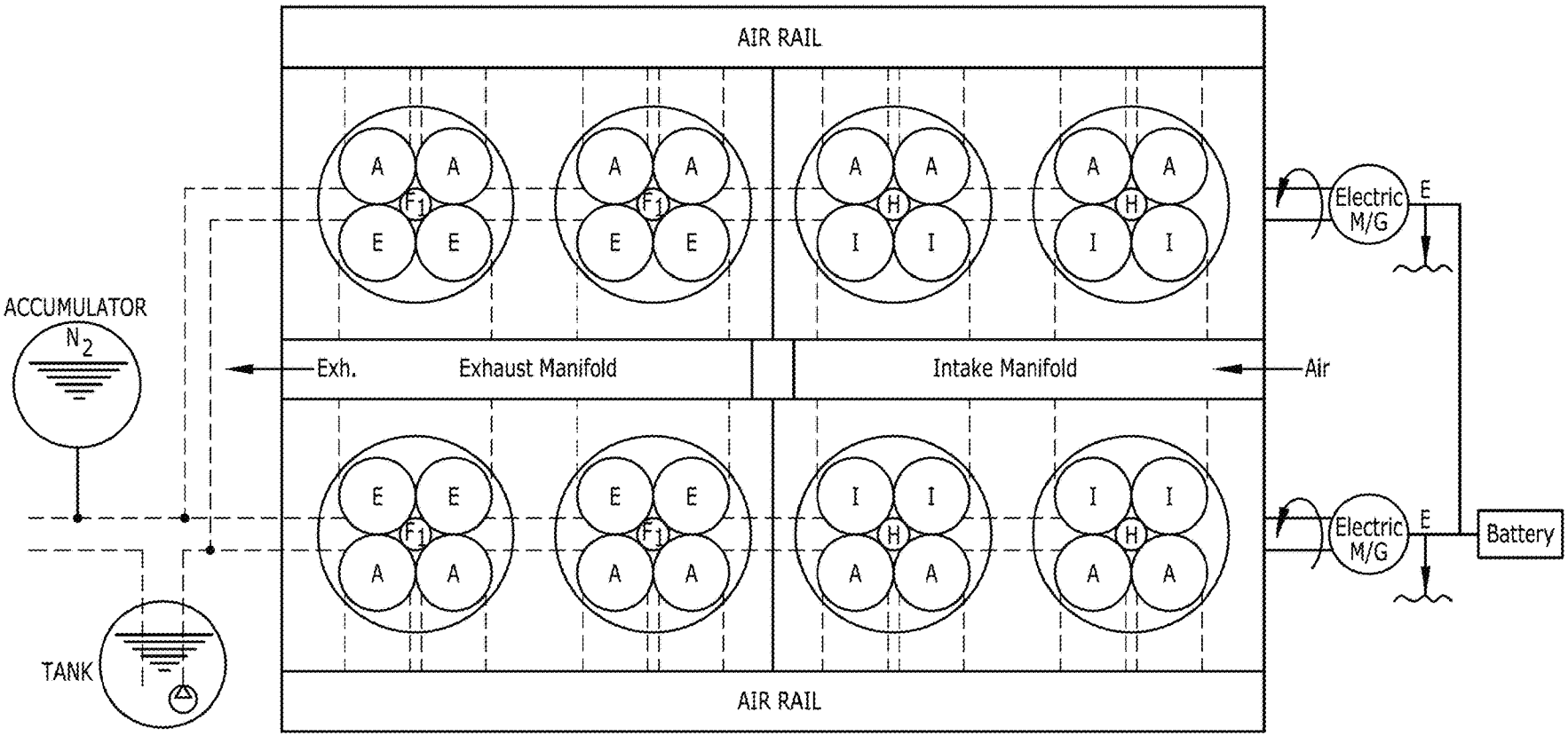
FIG. 1B illustrates a power plant comprised of a coupling of two engines each generally in accordance with FIG. 1A.
Figure 1C:
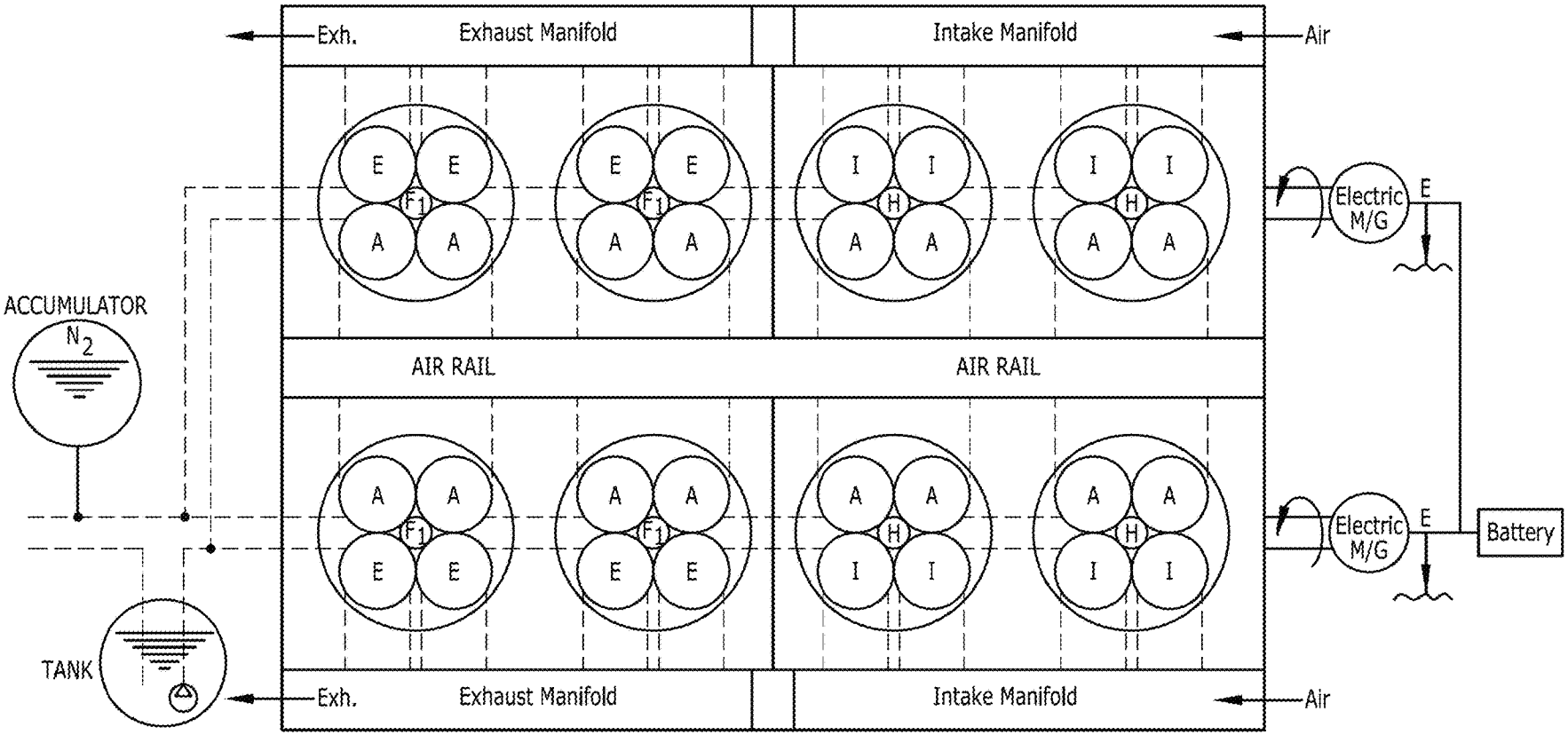
FIG. 1C illustrates two engines also each generally in accordance with FIG. 1A with an alternate coupling compared to FIG. 1B.
Figure 1D:
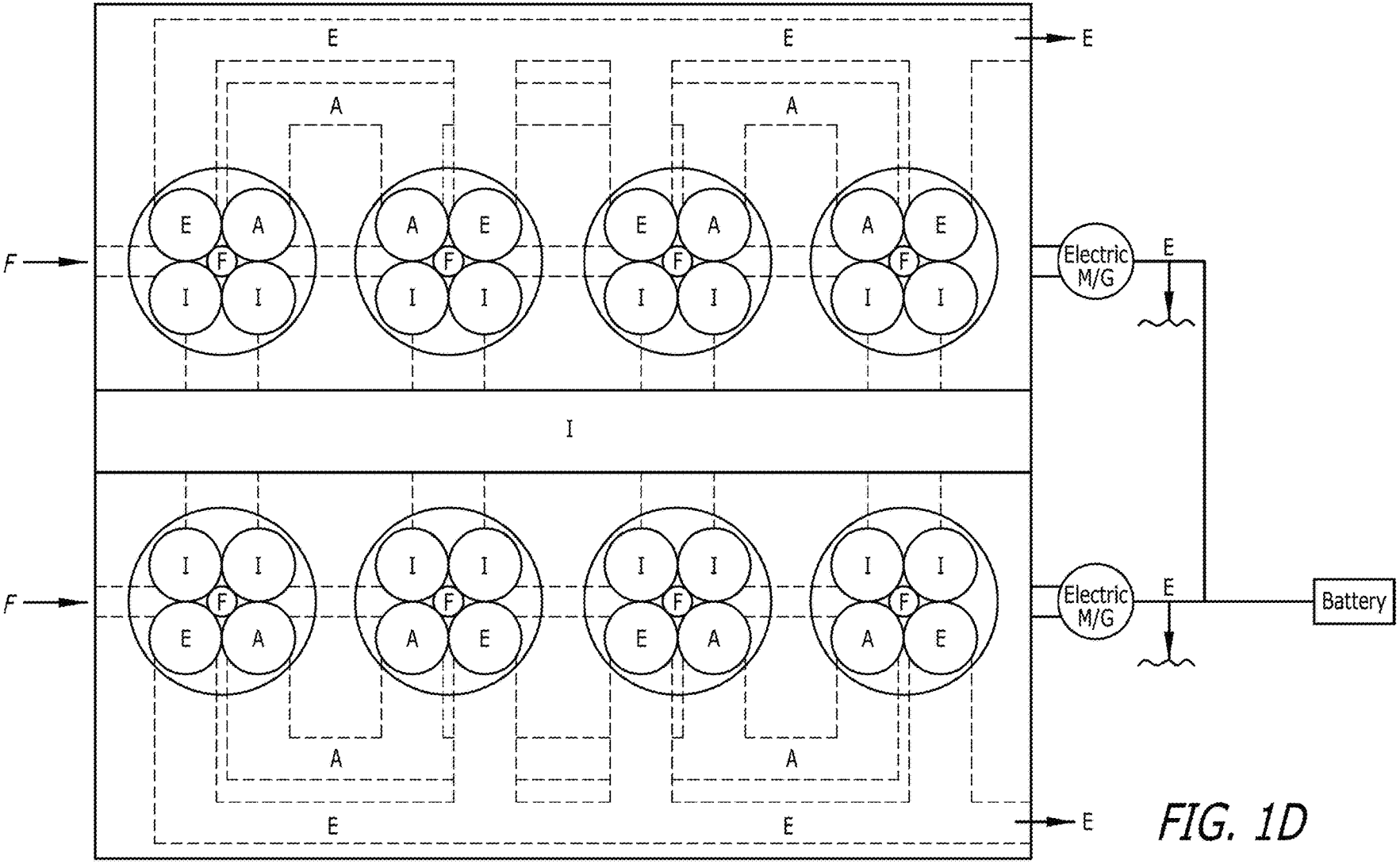
FIG. 1D illustrates a power plant comprising two identical engine block assemblies like FIGS. 1B and 1C, but with the hydraulic pumps H of FIGS. 1B and 1C replaced with additional fuel injectors F.

FIG. 1B illustrates the combination of two engines each generally in accordance with FIG. 1A coupled together at least in part through common intake and exhaust manifolds. These two engines would have identical engine block assemblies (to be further described herein), though with different engine valve utilization so that the second engine valving is the mirror image of the first engine. FIG. 1C illustrates two engines also each generally in accordance with FIG. 1A coupled together at least in part through a common intake air rail. As a further embodiment, FIG. 1D illustrates a power plant comprising two identical engine block assemblies like FIGS. 1B and 1C, but with the hydraulic pumps H of FIGS. 1B and 1C replaced with additional fuel injectors F. This engine has the advantage of being operable using each cylinder sometimes as a compression cylinder and at other times as a combustion cylinder for even wear and cooling requirements. It has the further advantage of allowing adding an air storage tank to the air rail to store energy faster than the earlier embodiments when a vehicle is using the engine as a brake, and can give a strong burst of power when needed by operating all cylinders as combustion cylinders, even in 2 stroke cycles. It has the disadvantage however of not automatically providing high pressure fluid (hydraulic fluid, engine oil or fuel for operating electronically controlled and hydraulically operated engine valves and fuel injectors such those of the foregoing patents, by way of example, and for operating other hydraulically operated accessories and/or providing a direct hydraulic power output.

Figure 3:
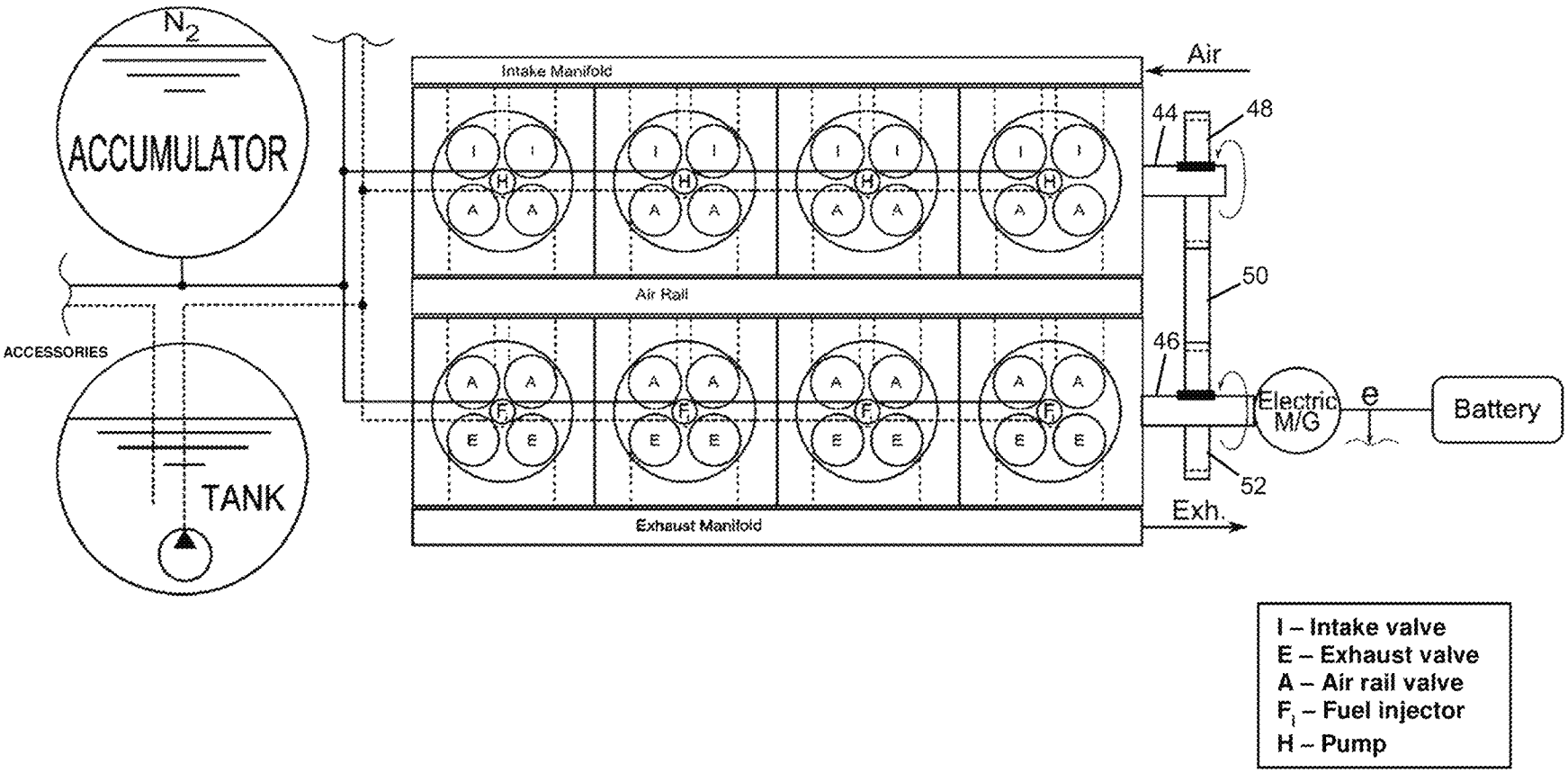
FIG. 3 illustrates another embodiment of the power plant of the present invention based on the exemplary four-cylinder piston engine assembly of FIG. 1A.

Another embodiment of the power plant of the present invention is based on the exemplary four-cylinder piston engine assembly of FIG. 1A, but in a unique assembly. As shown in FIG. 3, there appears to be some form of eight-cylinder engine, which actually is made up of two four-cylinder blocks, which can be identical piston engine blocks, each with crankshafts 44 and 46 which are geared for rotation in unison through gears 48, 50 and 52. While the gearing schematically illustrated results in the rotation of the crankshafts in the same direction, that rotation is not a limitation of the present invention, provided the engine is properly controlled in accordance with the rotation of each crankshaft, as any engine may be operated in the opposite direction of rotation using the flexibility of the electronic valve and injector control. Similarly, while the schematic diagram of FIG. 3 suggests that the crankshafts 44 and 46 rotate at the same speed, this, too, is not a limitation of the invention, and in fact, it will be seen that there may be advantages in having the two crankshafts rotate at unequal speeds. In particular, the upper engine block (upper in the illustration of FIG. 3, though physically side-by-side with a common Air Rail between the two blocks) has all four of its cylinders used as compression cylinders (and hydraulic pump cylinders) and all four cylinders of the lower block used for combustion or power cylinders. Rotation at unequal speeds, typically with the upper crankshaft rotating at a higher speed, allows the compression cylinders to provide more air to the combustion cylinders, increasing the power attainable by the engine, and helping in operating the engine in a two stroke cycle.

Figure 4:
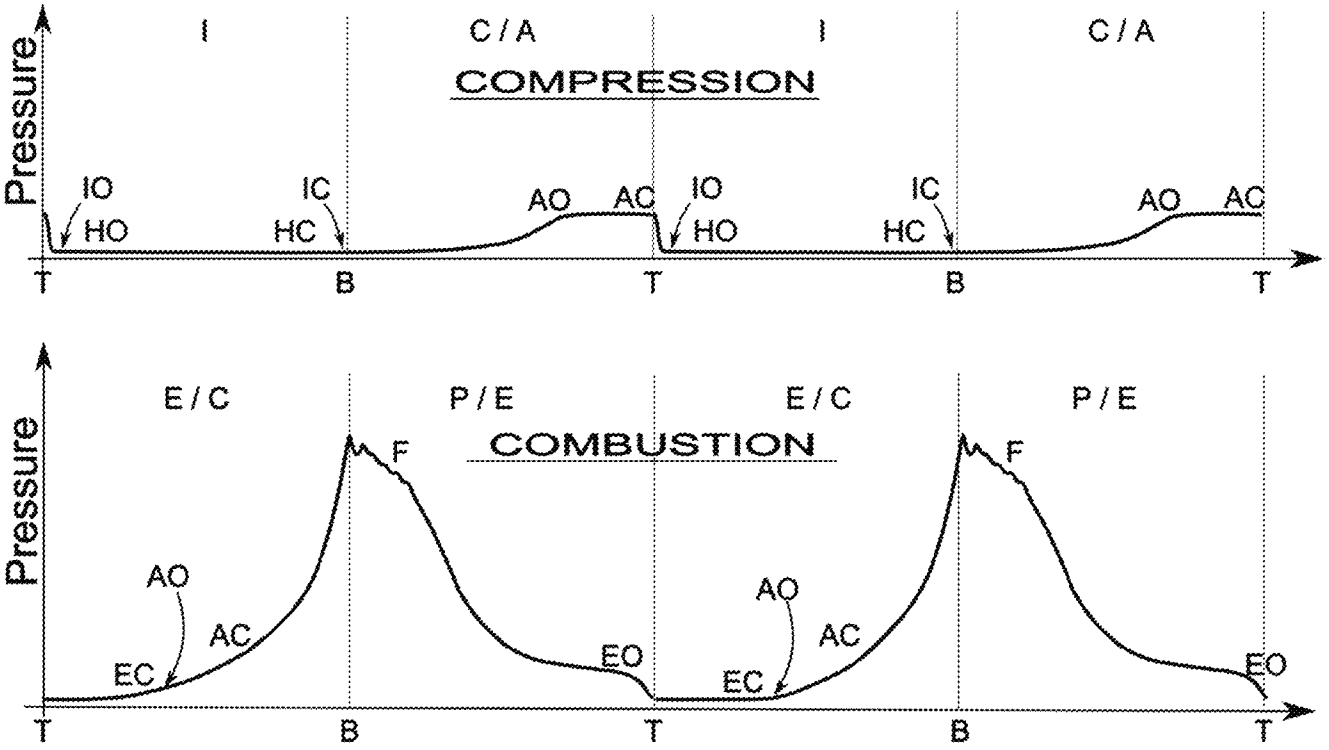
FIG. 4 illustrates the operation of the engine of FIG. 3, among others of the present invention.

Operation of the engine of FIG. 3 (and most other engines disclosed herein) in a two stroke cycle is illustrated in FIG. 4. In FIG. 4, the nomenclature used to illustrate the cycles is that the first letter indicates the valves involved, as per the valve identifications of FIG. 1A, and the second letter, O or C, represents a change in the valve position to the state identified, O for open and C for closed. The compression cycles are self-explanatory, delivering compressed air to the air rail at the pressure of the air rail, or a slightly higher pressure.

With respect to the lower illustration of FIG. 4, as the respective left side piston descends from the top dead center position, some exhaust gas is returned to the combustion cylinder as EGR. Then during the rest of the compression stroke, at an appropriate time the air valve A is opened (AO) to receive the pressurized air from the air rail and later closed at AC, with the rest of the compression stroke being conventional. At or near top dead center, the liquid fuel injector is pulsed to initiate combustion and then later pulsed successively to maintain combustion through a larger crankshaft angle than a steady injection would create, which has the advantage of maintaining combustion chamber pressure over a larger crank angle for more efficient conversion of the pressure energy to mechanical energy. Then at or near the following expansion or power stroke, the exhaust valve is opened (EO) and remains open at the end of the exhaust stroke.

Another reason for limiting the duration of any injection pulse is to prevent an excessive buildup of the boundary layer around the injected fuel. In particular, in a more sustained injection, a boundary layer builds up around the injected fuel, part of which boundary layer will normally have a stoichiometric or near stoichiometric fuel/air ratio. On combustion, this will result in local very hot regions, hot enough to create some level of $NO_X$. Pulsing the injections terminates the growth of the boundary layer on each injection pulse, with a new boundary layer starting on the next injection pulse. In this way, the maximum boundary layer thickness becomes highly limited, with heat from the burning stoichiometric or near stoichiometric areas of the thin boundary layer being rapidly transferred to the cooler adjacent combustion chamber regions and to the fuel spray itself. Consequently, one obtains excellent control of the maximum temperatures in the combustion chamber, and thus can substantially eliminate the generation of $NO_X$.

Figure 5:
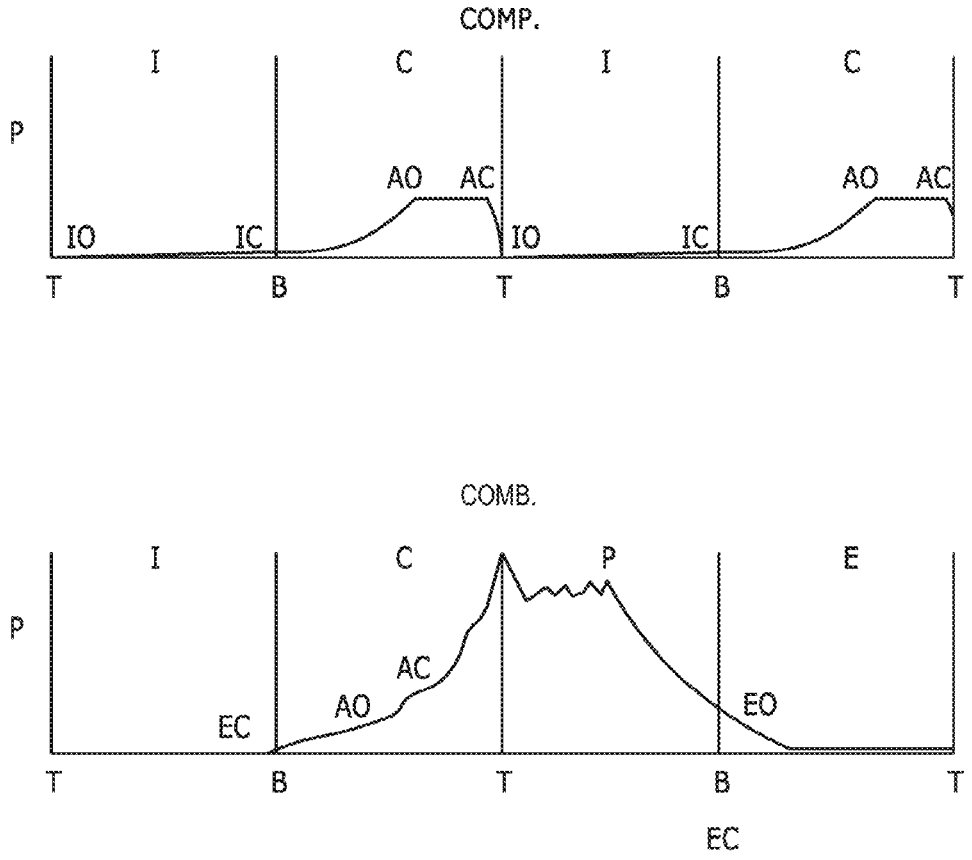
FIG. 5 illustrates four stroke operation of the engines of FIG. 3.

A four stroke operation of the engines of FIG. 3 is illustrated in FIG. 5. The compression cycles are the same as previously described with respect to FIG. 4. For the combustion cycle, the exhaust valves may be left open to execute an non-operative intake stroke, after which the exhaust valves are closed, and the air valves are opened AO and then closed AC early in the compression stroke, followed by the remainder of the compression stroke to pulsed injection and ignition at or near top dead center, with the pulsing continuing as previously described. At the end of the combustion stoke the exhaust valve is opened and held open until the end of the next dummy intake stroke.

Figure 6:
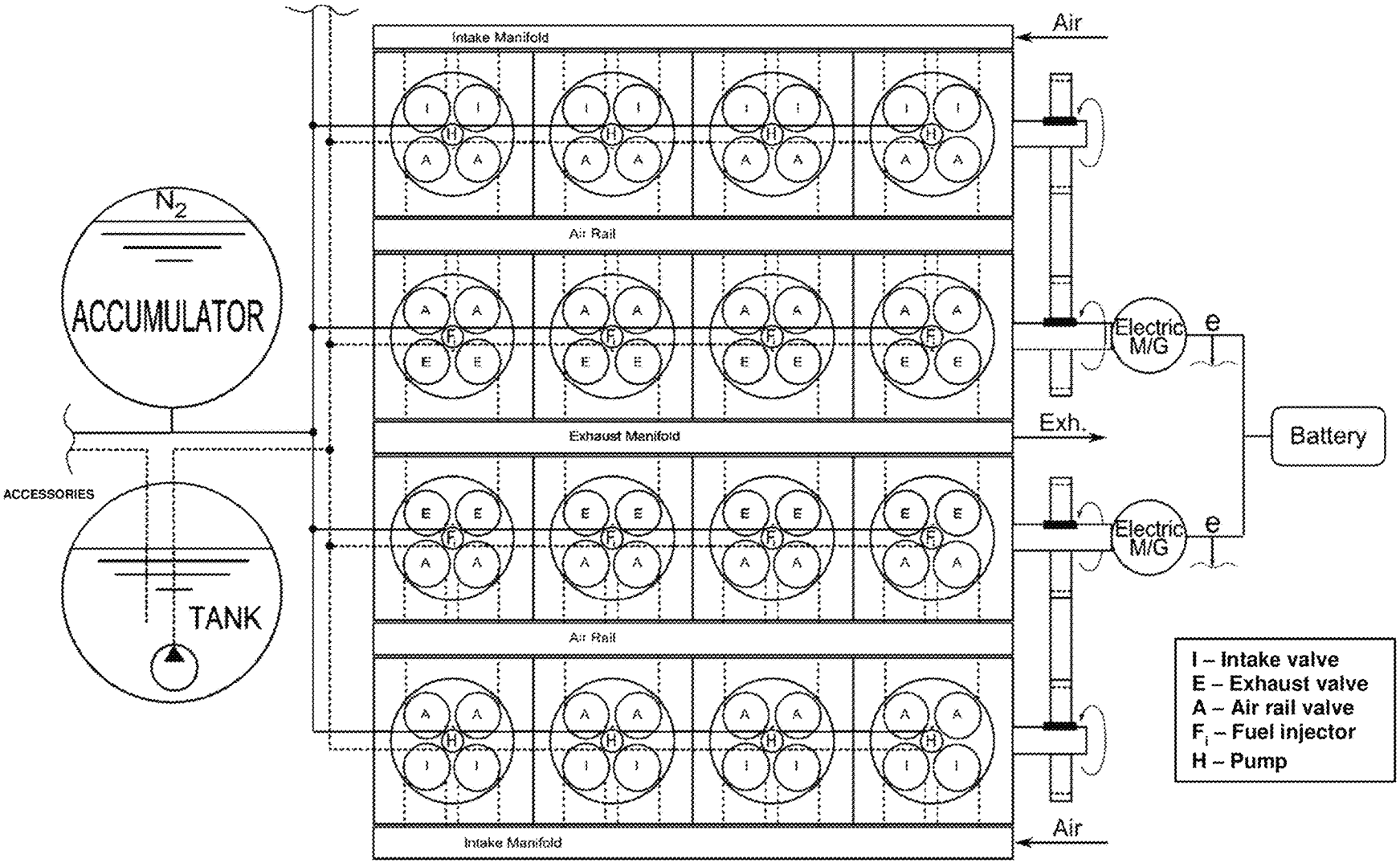
FIG. 6 illustrates a power plant using two engines in accordance with FIG. 1B.
Figure 7:
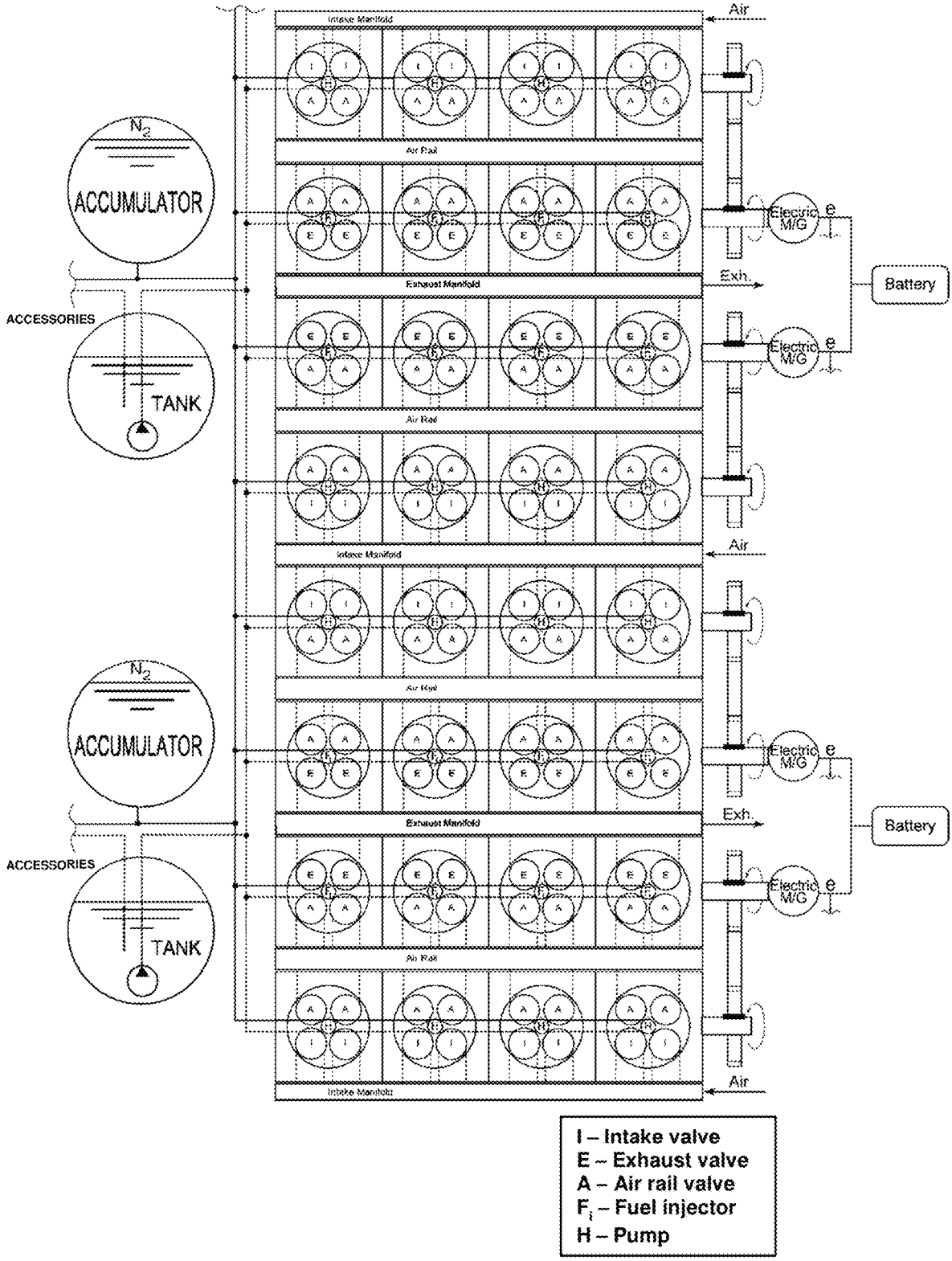
FIG. 7 illustrates a power plant using four engines in accordance with FIG. 1B.

The engines of FIG. 3 (or even those of FIG. 1A) may be ganged to provide even greater output power as desired, such as shown in FIGS. 6 and 7.

Figure 9:
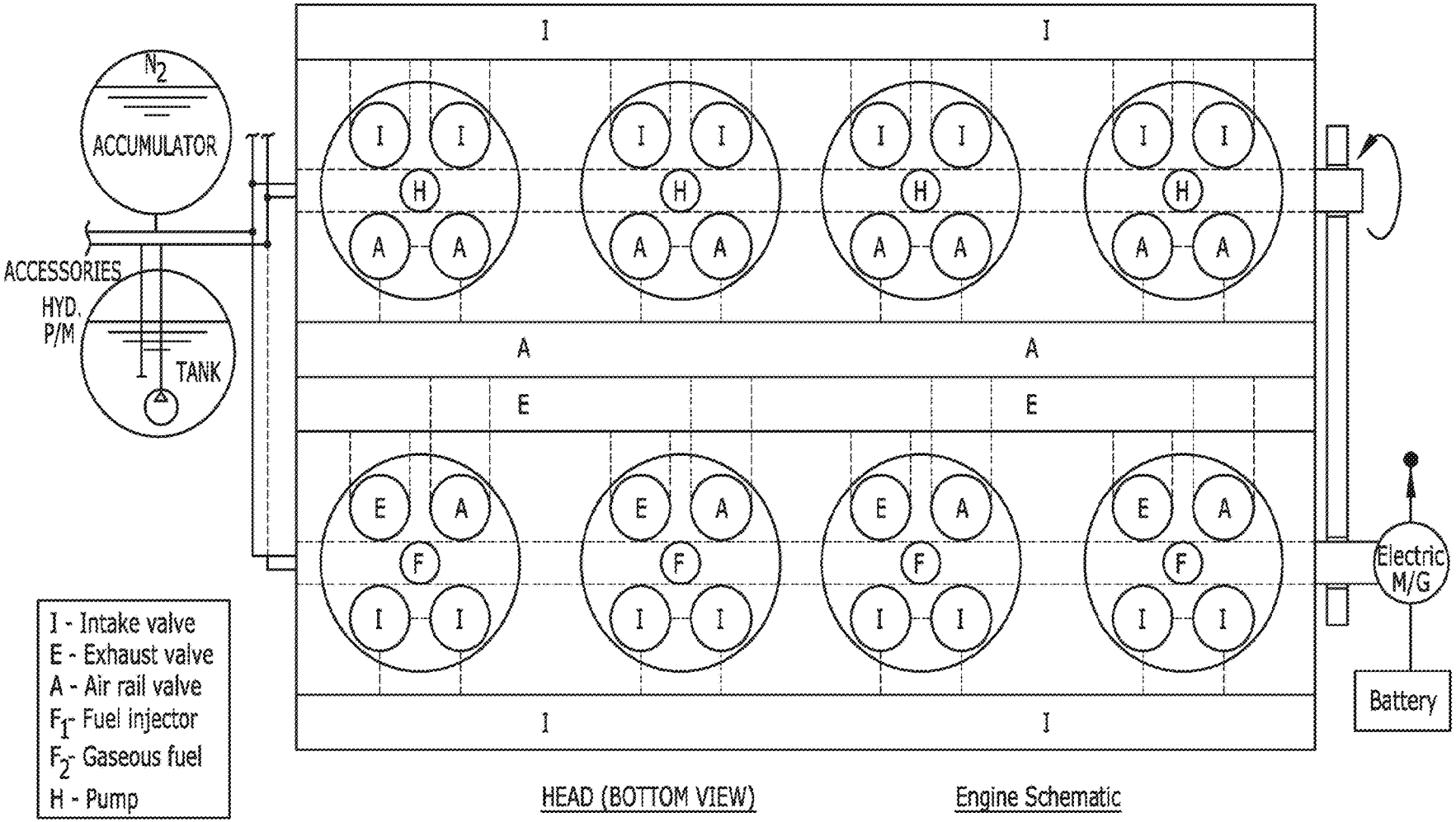
FIG. 9 presents a still further embodiment of the present invention.

Now referring to FIG. 9, a still further embodiment of the present invention may be seen. This embodiment, like the others, uses two four-cylinder engine blocks, which may be identical engine block assemblies, the upper block in the head layout of the Figure being for compression of air received from the upper intake manifold I to deliver compressed air to the air manifold A, with the lower combustion cylinder valves having a slightly different arrangement than the earlier embodiments. In particular, the head for lower cylinders includes two intake valves I for receiving intake air from the lower intake manifold, an air valve A for receiving air from the air rail A, and an exhaust valve for exhausting to the exhaust manifold E. As before, of course, there is a liquid fuel injector in each such cylinder.

It may be seen in FIGS. 9 and 1A that the valving in the engine head for the upper engine block assembly of FIG. 9 is the same as for the two compression cylinders at the right of FIG. 1A. However the valving for the lower cylinders in FIG. 9 is significantly different from the left two cylinders of FIG. 1A. In particular the cylinders of the lower engine block assembly of FIG. 9 may be coupled to the intake manifold, the exhaust manifold and the air rail. Further while the porting for the air valves A is drawn differently than the porting for the intake valves I in the upper engine block assembly of FIG. 9, these and other Figs. are only illustrating alternatives, and the porting in the heads may be identical for all valves and all heads if each valve is ported separately in the respective head (assuming overhead valving), with differences in the porting destinations, so to speak, being determined by bolt on manifolds. Further, for an engine head designed for diesel operation, the hydraulic pumps H may be fitted into any diesel injector opening in the head because of the typically larger diameter of diesel injector than a hydraulic pump of the type preferably used as described herein, so that such a head or head design may be directly used in the multiengine embodiments of the present invention, such as FIGS. 3, 6 and 7, by way of example, or at least with minimum redesign.

Figure 10:
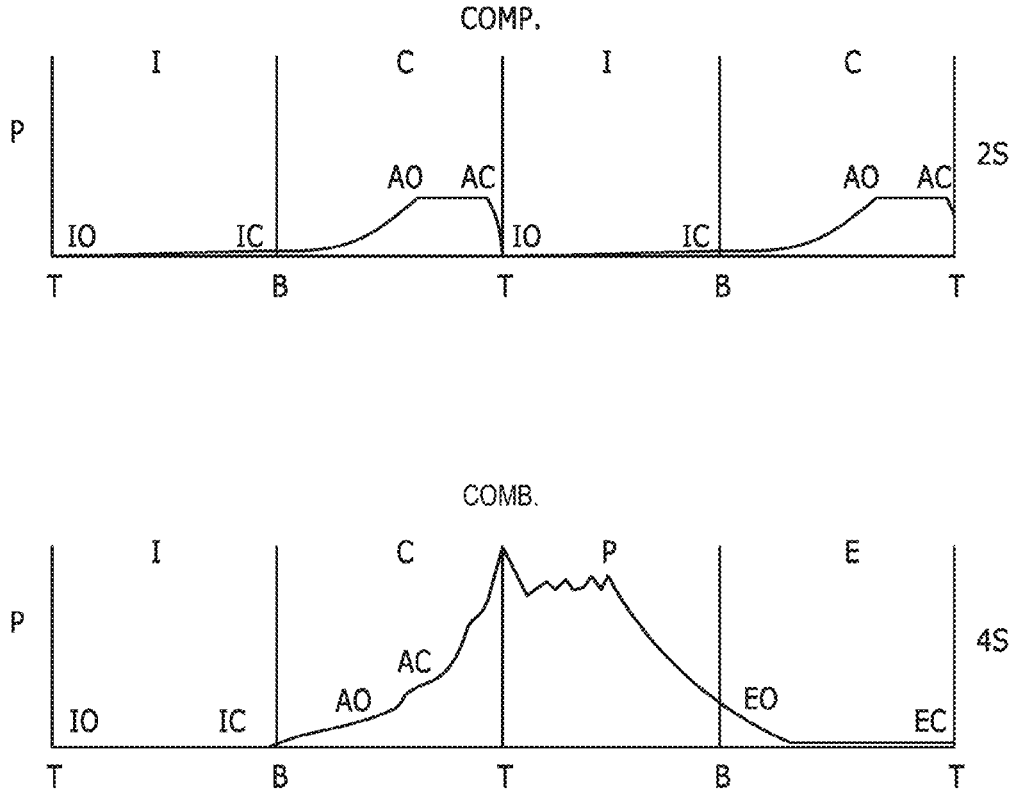
FIG. 10 illustrates an exemplary operation of an engine in accordance with FIG. 9.

An exemplary operation of such an engine may be seen in FIG. 10. Here, the compression cycles are the same as previously described. The lower illustration in FIG. 10 is for a four-stroke combustion cycle. Unlike the earlier described power plants, a normal intake cycle is executed as an engine piston declines in the intake cycle I, with the intake valve opened (IO) at the beginning of the downward movement of the engine piston and closed (IC) at the bottom dead center position of the piston. Then during the compression stroke, while the combustion chamber pressures are still below the pressure in the air rail, the valve A coupled to the air rail is opened (AO), and then closed (AC), to take in air from the air rail, then followed by ignition at or near top dead center by pulsing the fuel injector F, followed by continued pulsing through the power stroke, with the exhaust valve opening when the piston reaches the bottom dead center position, and then being closed at the end of the exhaust stroke.

The advantage of this embodiment is that it allows, essentially, recovery of part of the exhaust heat by adding heat to the pressurized air in the air rail. In that regard, note that in accordance with the power plants disclosed, combustion cylinders that are operative are generally operative at a substantial power setting, so that the exhaust temperature will normally be high enough to transfer heat to the air rail A. Note also that such engines are easily ganged by matching intake manifold to intake manifold, which may well be a single intake manifold between engines.

Figure 11:
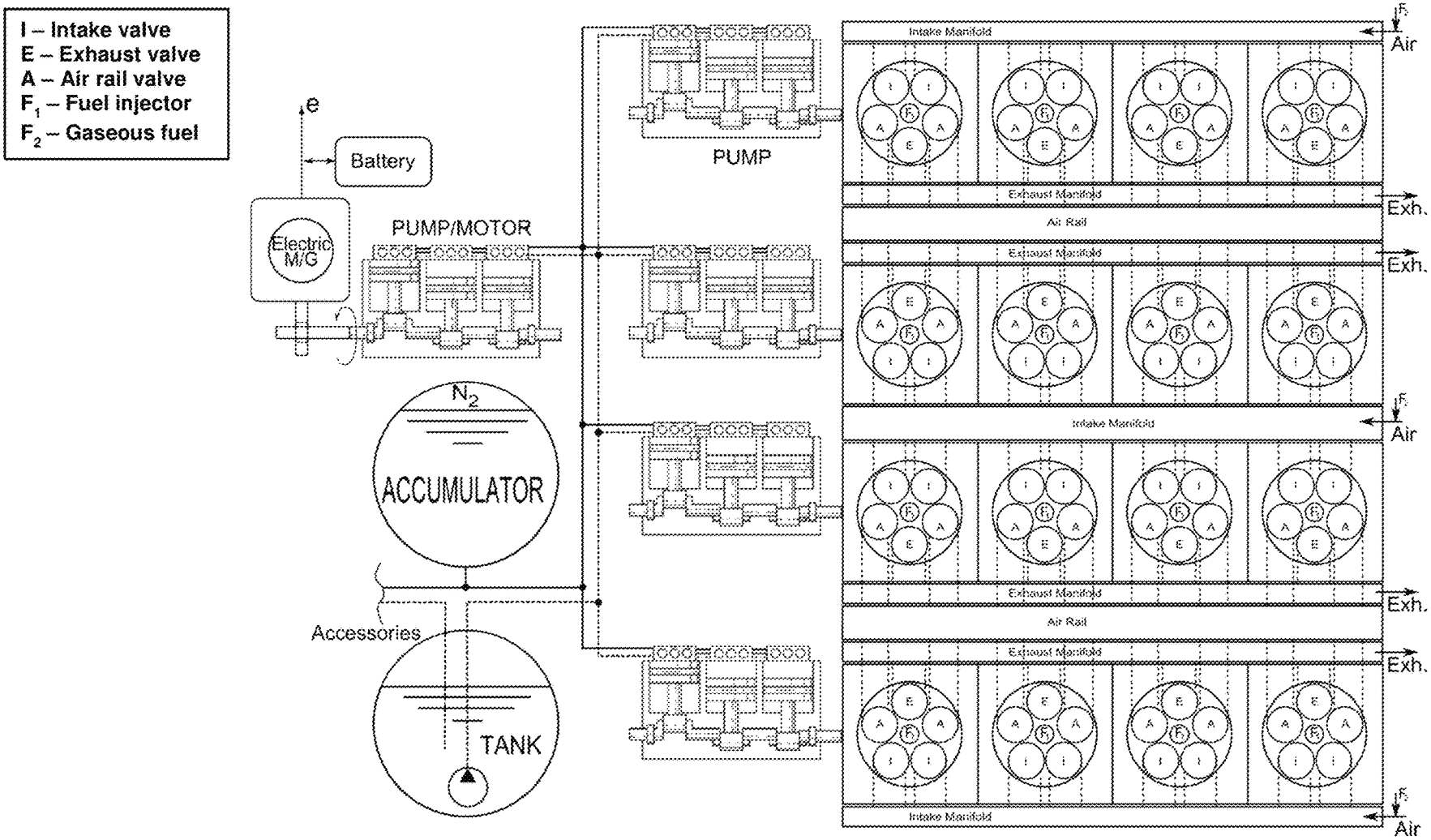
FIG. 11 illustrates a further embodiment of the power plants of the present invention with four, four-cylinder ganged engines.

A further embodiment of the power plants of the present invention with four, four-cylinder ganged engines is illustrated in FIG. 11. In this Figure, each head has five engine valves per cylinder, namely, an intake valves I coupled to an intake manifold, air valves A coupled to an air rail, and an exhaust valve E coupled to an exhaust manifold. The first and second engines share an air rail, the second and third engines share an intake manifold, and the third and fourth engines share another air rail. As may be seen, the exhaust of the first and second engines provides heat energy to one of the air rails, and the third and fourth engines provide heat energy to the second of the air rails. Each output of the engines drives a respective hydraulic pump which drives a larger pump/motor. As before, a hydraulic accumulator may be used, as well as energy storage in the air rail, which as stated before may include a separate compressed air storage tank, not shown. As before, all valves and injectors are electronically controlled, and the engines are camless, as are all prior embodiments.

Figure 12:
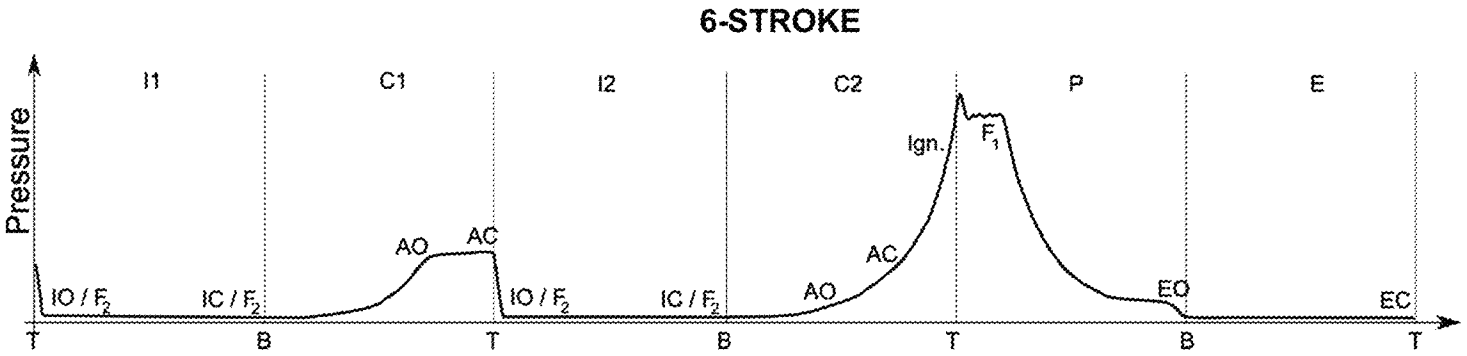
FIG. 12 illustrates another exemplary operating sequence for some of the power plants of the present invention.

One of the unique aspects of this embodiment is the fact that the engines may run as compression ignition engines on liquid fuel only, such as hemp or diesel fuel injected by injectors $F_1$ into the combustion chamber at the proper time for compression ignition, or on a gaseous fuel $F_2$ such as compressed natural gas mixed in the intake manifolds using a pulse of liquid fuel at or near the top dead center position of the engine piston to initiate ignition. An exemplary operating sequence is illustrated in FIG. 12. The compression sequence for supplying compressed air to the air rail is as before, with the exception of the addition of gaseous fuel $F_2$, illustrated as being simultaneous with the air intake. Then the combustion sequence compression C2, power P and exhaust E strokes are also as described before, preferably using pulsed injection as previously described for ignition and sustaining combustion through a relatively large crank angle.

As a still further embodiment, engines in accordance with the present invention can be ganged with gearing using over running or freewheeling clutches between at least some engines to allow the actual shutting down of one or more engines, thereby not only eliminating the power contribution of such engines to the output of the power plant when reduced output power is needed, but to also eliminate the friction of those engines, thereby allowing the engines that remain operating to operate at or very near their maximum efficiency. Of course a power plant of a general configuration as shown in FIG. 6 achieves a similar purpose in that one engine may be shut down while the second engine provides the required output power. Also even though the engines of FIG. 1A and FIG. 6 use the same engine block assembly, the configuration of FIG. 6 allows the operation of one or two engines to provide the overall output power, whereas engines in accordance with FIG. 1A when used in a configuration like that of FIG. 6, each with its own separate electric motor/generator, would eliminate expensive gearing between engines and allow shutting down one, two or three engines, thereby reducing cost and providing a finer division of power output while maintaining the operation of each engine closer to its most efficient operating condition. In either case, one can vary which engine or engines will be shut down for lower power output, thereby balancing wear between engines and/or allowing servicing, maintenance or even replacement of engines, one at a time, while still maintaining a useful output power level. In fact a redundant engine may be provided in critical applications to automatically start when needed on an unscheduled shutdown of one of the other engines, and to allow full rate power output of the power plant during a scheduled shutdown of any one of the engines.

Further, while aspects of the present invention have been disclosed herein with respect to an even number of four cylinder engine blocks, engine blocks of greater or lesser number of cylinders, and/or an odd number of engine blocks could be used if desired, all within the principles of the invention.

In the foregoing description, certain exemplary operating cycles were described, generally with respect to the electronically controlled operation of the engine valves and fuel injectors, though precise values for the timing of the operation of these devices and the duration of operation was not set forth. One of the key aspects of the invention is the fact that the precise values for the most efficient operation (or any other operating mode such as the highest power mode) are essentially determined by the engines themselves. In that regard, a block diagram of an exemplary controller for the engines of a power plant of the present invention may be seen in FIG. 8 for controlling N ganged engines, whether of the embodiments disclosed herein or otherwise. Some measure of overall power plant output, such as total generated electrical power, or shaft power if shaft power is the desired output, is provided to feed back to the controller. Thus the controller can make incremental adjustments in valve timing and duration, as well as fuel injection, and together with an input of the fuel flow rate (which could be overall or per engine), can seek the best setting for these parameters for maximum efficiency (assuming that is the desired performance at the time) under any engine operating characteristics.

This is important to the present invention, as it is desired to be able to operate any number of engines or portions of an engine in an optimum manner, typically the most efficient manner, though some other desired characteristic may be desired at the time, such as maximum power, or even absolute minimum emissions or minimum noise. This is to be compared with the four, six and eight cylinder operation of eight-cylinder engines. In particular, in four, six and eight-cylinder operation of eight-cylinder engines, greater efficiency is obtained in eight-cylinder gasoline engines by shutting down two or four cylinders for lower engine loads. However it should be noted that in doing so, there are still potential inefficiencies that could be eliminated, as are eliminated in the present invention. In particular, operating an eight-cylinder engine on four cylinders generally carries with it the friction and other loses of an eight-cylinder engine. Further, those four cylinders may well be operating in an off-optimum operating condition that could be corrected by operating three or five cylinders.

In the present invention, because the engines are smaller than the single large engine, smaller increments in optimum power may readily be obtained while not suffering the inefficiencies of the high friction of a single large engine. Of course the specific operating cycles that have been disclosed herein have been disclosed for purposes of explanation and not for purposes of limitation, as users of the concepts of the present invention may reconfigure the engines and change the operating cycles, as desired, simply by reprogramming the controller or providing separate manually operable controls for each power plant parameter, at least for engine operating parameters during the development process.

Figure 8:
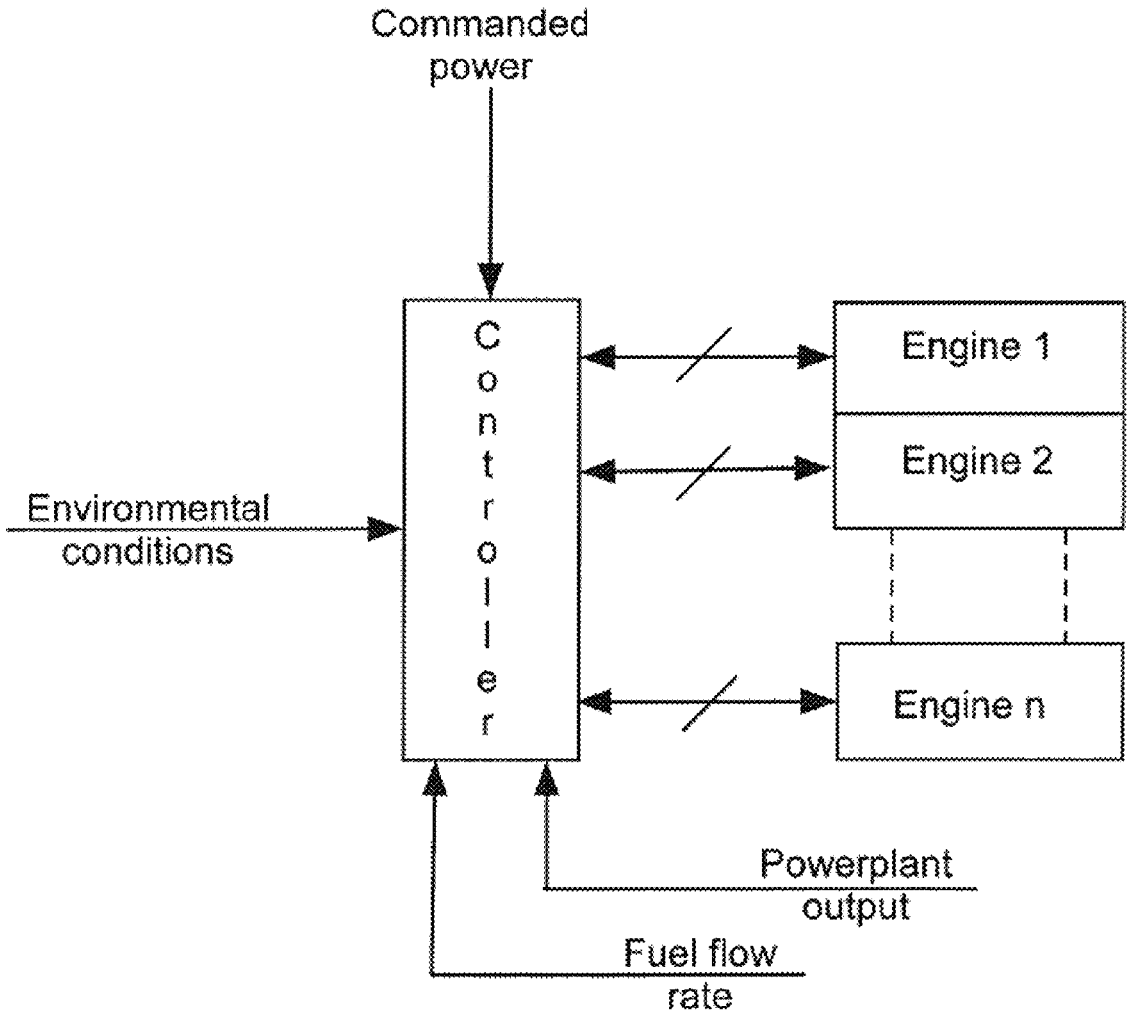
FIG. 8 presents a block diagram of an exemplary controller for the engines of a power plant of the present invention.

The controller shown in FIG. 8 obviously is a digital controller, essentially providing digital control to the valves and injectors, as well as selection of the engines and portions of an engine that would be operating in a power plant at any one time. Using the electronic control of the injectors, together with the pulsing previously described, combustion can be very well controlled. With respect to the fuel itself, an ideal fuel is hemp (though other fuels such as diesel and biodiesel may also be used). Hemp is preferred because it is economical, has high energy content and is multi-functional, being a lubricant, a fuel and a working fluid. The engines of the present invention when so configured are basically triple hybrid, having the ability to store energy in the compressed air in the air rails, which may further include one or more air storage tanks (not shown in the drawings), together with hydraulic accumulator energy storage and, of course, electric energy storage. These storage devices can store energy for extra bursts of power when needed, and in fact, when there is an increase in power needed, any of these three storage devices can provide that extra power for whatever time it takes to start additional engines, if not much longer periods. Thus the invention provides flexibility and adaptability under all conditions. It is also highly reliable, particularly with its built-in redundancy, typically with some extra capacity. Typically, smaller engines are lighter in weight, but when combined in plurality to provide the power of a larger engine, are also usually lighter in weight. The closed loop control described, which optimizes the engines' operation, assures the best performance at all times. The power plants of the present invention also eliminate certain expensive mechanical parts, such as a high pressure fuel pump, by using injectors of the intensifier type. The engines can easily be configured for practical stacking or ganging and use the same parts for multiple purposes, at least one embodiment having a unique waste heat recovery system.

The power plants of the present invention use identical engine block assemblies, which helps reduce cost. The phrase identical engine block assemblies as used herein and in the claims means that such assemblies use internal parts of the same design, such as, for crankshaft engines, pistons, connecting rods, crankshafts and bearings, though the external parts may differ somewhat, such as, for example, different blocks themselves may have different mounting provisions, etc., though ideally the number of variations should be held to a minimum to simplify manufacturing, inventorying and maintenance of the engines. In that regard, smaller block assemblies, etc., manufactured in very large quantities, can be highly reliable and less costly, even when used in plurality to provide the power of a large engine. The power plants of the present invention also eliminate the need for very expensive large backup engines, which tend to be more expensive than a plurality of smaller engines because of the quantities in which smaller engines are produced. This savings is amplified by the fact that the entire power plant need not be replicated, but only the number of engines that in a worst case scenario, might fail simultaneously need be replicated. The heads of the identical engine block assemblies may be identical or differ somewhat. If desired, wet sleeve engines may be used, essentially allowing each engine block assembly to be entirely rebuilt numerous times. Also free piston engines may also be used, such as, by way of example, those of U.S. Pat. Nos. 8,596,230, 9,464,569 and 9,206,738, the disclosures of which are hereby incorporated by reference. Such engines provide a direct hydraulic output, eliminating the need for a hydraulic pump on the power plant output, such as used in the embodiment of FIG. 11, though which can be used with any embodiment.

In general, while the embodiments disclosed herein have a shared air rail or manifold between adjacent engines, that is not a limitation of the invention, as multiple identical engine block assemblies may be mounted side by side with independent air rail and manifolds, or mounted to share engine functions such as in the embodiment of FIG. 3 using independent but coupled air rails. In embodiments that share engine functions such as in the embodiment of FIG. 3, a power plant may be comprised of two or more identical engine block assemblies, though for this and particularly other embodiments, while a power plant may be comprised of two identical engine block assemblies, normally a minimum number will be three, or even four or more identical engine block assemblies will be used. In ganging the identical engine block assemblies, normally the identical engine block assemblies would be structurally tied together in addition to any common manifold or air rail coupling. In that regard, the present invention is applicable to the ganging of identical engine block assemblies of engines of any design, preferably compression ignition engines, though not limited to those using an air rail as in the embodiments herein. In the present invention, the identical engine block assemblies are mounted parallel and not tilted with respect to each other. Also while geared assemblies of identical engine block assemblies as previously described clearly can be used, any of the power plants of the present invention can be used with its output coupled to a hydraulic pump as in the embodiment of FIG. 11 or a motor or motor/generator as in other embodiments disclosed, which well facilitates the complete shutting down of engines when necessary or when their output power is not needed, and as providing probably a lower cost, longer life implementation. In all embodiments, engine synchronizers may be used to eliminate cyclic vibration that results from two or more engines running at slightly different speeds.

It was previously mentioned that the controller preferably operates in closed loops, essentially with substantially infinite variability in the engine valve and fuel injector operation, and thus has great flexibility and accuracy in the operating cycles of any of the engines of the present invention power plants. The one parameter that is not variable, or is not easily made variable, is the ratio of the crankshaft speed of compression cylinders with respect to the crankshaft speed of the combustion or power cylinders. Typically during development of an engine for a power plant in accordance with the present invention, one would test various speed ratios to determine which is the best to use in the intended final power plant. Alternatively, a variable speed drive could be incorporated between those two crankshafts for development purposes, also even with a closed loop control, or in fact, could be used in production of the power plants, should the advantage of being able to vary the speed ratio under various conditions be found to outweigh the additional cost to incorporate such a variable speed drive. Thus the present invention in its various embodiments, including but not limited to those disclosed herein, provides extreme flexibility in the control of the engines in a power plant to provide very high efficiency with long life and ease of maintenance.

In the foregoing description, four cylinder inline block assemblies were used for the exemplary design, though that is not a limitation of the invention. Block assemblies of more or fewer cylinders, of an odd number of cylinders or of a V configuration could be used if desired, though four cylinder inline blocks have the advantage of providing reasonably uniform crankshaft power output, yet are simpler and have fewer parts than block assemblies with greater numbers of cylinders and are more readily packaged in the multiple engine block power plants of the present invention.

Further, while operation of the power plants of the present invention on diesel fuel represents a preferred embodiment, gaseous fuels may also be injected, such as in the intake manifold, and ignited such as by the injection of a diesel fuel when ignition is desired, though direct compression ignition of a gaseous fuel is possible under some operating conditions. Finally, the drawings presented herein of preferred embodiments suggest that the multiple engine block internal combustion power plants of the present invention are all of an overhead valve configuration. While that is not a limitation of the invention, currently there are no electronically controlled engine valve systems for other engine valve configurations, or at least none known that have achieved any significant notoriety, and electronic control of both engine valve timing and injection timing is essential for total enjoyment of the flexibility and advantages of the present invention multiple engine block internal combustion power plants Thus the present invention has a number of aspects, which aspects may be practiced alone or in various combinations or sub-combinations, as desired. Also while certain preferred embodiments of the present invention have been disclosed and described herein for purposes of exemplary illustration and not for purposes of limitation, it will be understood by those skilled in the art that various changes in form and detail may be made therein without departing from the spirit and scope of the invention.

What is claimed is:

1. A multiple engine block internal combustion power plant comprising:

first and second identical engine block assemblies, each having N pistons therein in N cylinders and each piston being coupled to a respective crankshaft through respective connecting rod assembles, and each having an engine head thereon to form one of the identical engine block assemblies;

at least one intake manifold, at least one exhaust manifold and at least one air rail being coupled to each engine assembly;

the identical engine block assemblies being side by side;

the first and second identical engine block assemblies being connected to the same air rail, or to the same intake and exhaust manifolds;

wherein at least one cylinder in each identical engine block assembly is dedicated as a compression cylinder having at least one valve coupled to the intake manifold for taking in air during an intake stroke of the respective piston and at least one air valve coupled to the air rail for delivering pressurized air to the air rail during a compression stroke of the respective piston;

wherein at least one cylinder in each identical engine block assembly is dedicated as a combustion cylinder having at least one valve coupled to the air rail for taking in pressurized air from the air rail, and at least one valve coupled to the exhaust manifold;

wherein the each identical engine block assembly includes a crankshaft output power utilization system that allows shutting off of one engine formed by the first identical engine block assembly while still operating a second engine formed by the second identical engine block assembly.

2. The power plant of claim 1 further comprised of a fuel injector in each combustion cylinder coupled to inject a fuel into the respective cylinder.

3. The power plant of claim 2 wherein all fuel injectors and all valves are electronically controlled.

4. The power plant of claim 1 further comprised of a hydraulic pump coupled to the piston in each compression cylinder.

5. The power plant of claim 1 wherein the crankshaft output power utilization system includes a generator and battery.

6. The power plant of claim 1 wherein the crankshaft output power utilization system includes a hydraulic pump and accumulator.

7. The power plant of claim 1 wherein all valves and fuel injectors are electronically controlled.

8. The power plant of claim 1 wherein the number of identical engine block assemblies is at least two.

9. The power plant of claim 1 wherein the number of identical engine block assemblies is at least four.

10. The power plant of claim 1 wherein the power plant is a compression ignition power plant.

11. A multiple engine block internal combustion power plant comprising:

first and second identical engine block assemblies, each having N pistons therein in N cylinders and each piston being coupled to a respective crankshaft through respective connecting rod assembles, and each having an engine head thereon to form one of the identical engine block assemblies;

at least one intake manifold, at least one exhaust manifold and at least one air rail coupled to each identical engine block assembly;

the identical engine block assemblies being side by side;

the first and second identical engine block assemblies being connected to the at least one of the same intake manifold, the same exhaust manifold or the same air rail;

each cylinder of each identical engine block assembly having a fuel injector coupled to each cylinder of each identical engine block assembly;

each cylinder of each identical engine block assembly having at least one valve coupled to the at least one intake manifold, at least one valve coupled to the at least one exhaust manifold and at least one air valve coupled to the air rail;

each cylinder of each identical engine block assembly also having a fuel injector for injecting fuel into the cylinder for compression ignition;

whereby each cylinder of each identical engine block assembly sometime functions as a compression cylinder for providing compressed air to the air rail and as a combustion cylinder at other times for receiving compressed air from the air rail and fuel from the fuel injector.

12. The power plant of claim 11 wherein the power plant is a compression ignition power plant.

13. The power plant of claim 11 wherein the each identical engine block assembly includes a crankshaft output power utilization system that allows shutting off of one engine formed by the first identical engine block assembly while still operating a second engine formed by the second identical engine block assembly.

14. The power plant of claim 13 wherein the crankshaft output power utilization system includes a generator and battery.

15. The power plant of claim 13 wherein the crankshaft output power utilization system includes a hydraulic pump and accumulator.

16. The power plant of claim 13 wherein all valves and fuel injectors are electronically controlled.

17. The power plant of claim 11 wherein the number of identical engine block assemblies is at least two.

18. The power plant of claim 11 wherein the number of identical engine block assemblies is at least four.

19. The power plant of claim 11 wherein all fuel injectors and all valves are electronically controlled.

20. A multiple engine block internal combustion power plant comprising:

first and second identical engine block assemblies, each having N pistons therein in N cylinders and each piston being coupled to a respective crankshaft through respective connecting rod assembles, and each having an engine head thereon to form one of the identical engine block assemblies;

at least one intake manifold, at least one exhaust manifold and at least one air rail;

the first and second identical engine block assemblies being side by side;

the first identical engine block assembly having for each cylinder of the first identical engine block assembly, at least one valve coupled to the intake manifold and at least one valve coupled to the air rail, whereby the N cylinders of the first identical engine block assembly may operate as compression cylinders;

the second identical engine block assembly having N fuel injectors for injecting fuel into each of the respective cylinders, the second identical engine block assembly further having, for each cylinder of the second identical engine block assembly, at least one valve coupled to the air rail and at least one valve coupled to the exhaust manifold, whereby each of the N cylinders of the second identical engine block assembly receives air from the air rail and operate as combustion cylinders;

the first and second identical engine block assemblies sharing a common intake manifold, a common air rail or a common exhaust manifold;

wherein the each identical engine block assembly includes a crankshaft output power utilization system that allows shutting off of one engine formed by the first identical engine block assembly while still operating a second engine formed by the second identical engine block assembly.

21. The power plant of claim 20 wherein the power plant is a compression ignition power plant.

22. The power plant of claim 20 further comprised of N hydraulic pumps coupled to the piston in each cylinder of the first identical engine block assembly and hydraulic accumulator coupled to each hydraulic pump.

23. The power plant of claim 20 wherein the crankshaft output power utilization system includes a generator and battery.

24. The power plant of claim 20 wherein the crankshaft output power utilization system includes a hydraulic pump and accumulator.

25. The power plant of claim 20 wherein all valves and fuel injectors are electronically controlled.

26. The power plant of claim 20 wherein the crankshafts of the first and second identical engine block assemblies are geared together so that the crankshaft of the first engine assembly rotates in unison with the crankshaft of the second engine assembly in a ratio of the gears.

27. The power plant of claim 26 wherein the gear ratio is equal to one.

28. The power plant of claim 26 wherein the gear ratio is greater than one, whereby the crankshaft of the first engine assembly rotates faster than the crankshaft of the second engine assembly.

29. The power plant of claim 20 wherein the number of identical engine block assemblies is at least two.

30. The power plant of claim 20 wherein the number of identical engine block assemblies is at least four.

31. The power plant of claim 20 wherein all fuel injectors and all valves are electronically controlled.

* * * * *